United States Patent [19]

Mochida et al.

[11] Patent Number: 4,565,994

[45] Date of Patent: Jan. 21, 1986

[54] DETECTING DEVICE FOR DETECTING THE REMOVAL OF A CYLINDER LOCK

[75] Inventors: Haruo Mochida, Kiyokawa; Isamu Uemura, Yokosuka; Tokutaro Kurita; Toshikazu Kobayashi, both of Kawasaki, all of Japan

[73] Assignees: Nissan Motor Co., Ltd., Yokohama; Kokusan Kinzoku Kogyo Co., Ltd., Tokyo, both of Japan

[21] Appl. No.: 519,367

[22] Filed: Aug. 1, 1983

[30] Foreign Application Priority Data

Nov. 16, 1982 [JP] Japan ..... 57-19912

[51] Int. Cl.[4] ..... E05B 45/06

[52] U.S. Cl. ..... 340/542; 70/1.5; 200/61.64

[58] Field of Search ..... 340/542, 547; 70/1.5, 70/416, DIG. 49, 406; 200/61.64, 61.68

[56] References Cited

U.S. PATENT DOCUMENTS 3,587,080 6/1971 Hawkins ..... 340/274

4,249,161 2/1981 Mohnhaupt ..... 340/547 X

*Primary Examiner*—James L. Rowland

*Assistant Examiner*—Jeffery A. Hofsass

*Attorney, Agent, or Firm*—Schwartz, Jeffery, Schwaab, Mack, Blumenthal & Evans

[57] ABSTRACT

A device for detecting the removal of a cylinder lock used on cars, trunks, etc. when an unjust force is applied to the cylinder lock. The device also detects the locked and unlocked conditions of the cylinder lock. Magnets and magnetic sensor switches are used. A magnetic shield plate shields the flow of magnetic flux between the magnet and the magnetic sensor switch. When an unjust force is applied to the cylinder lock to take off the cylinder lock, the magnetic shield plate will be removed from between the magnet and the magnetic sensor switch, causing the magnet to energize the magnetic sensor switch, thereby detecting the removal of the cylinder lock.

In addition, when the cylinder lock is turned by a key, another magnet connected to a rotor of fixed on the cylinder lock approaches either of a pair of magnetic sensor switches, whereby the locked and unlocked conditions of the cylinder lock are detected.

7 Claims, 11 Drawing Figures

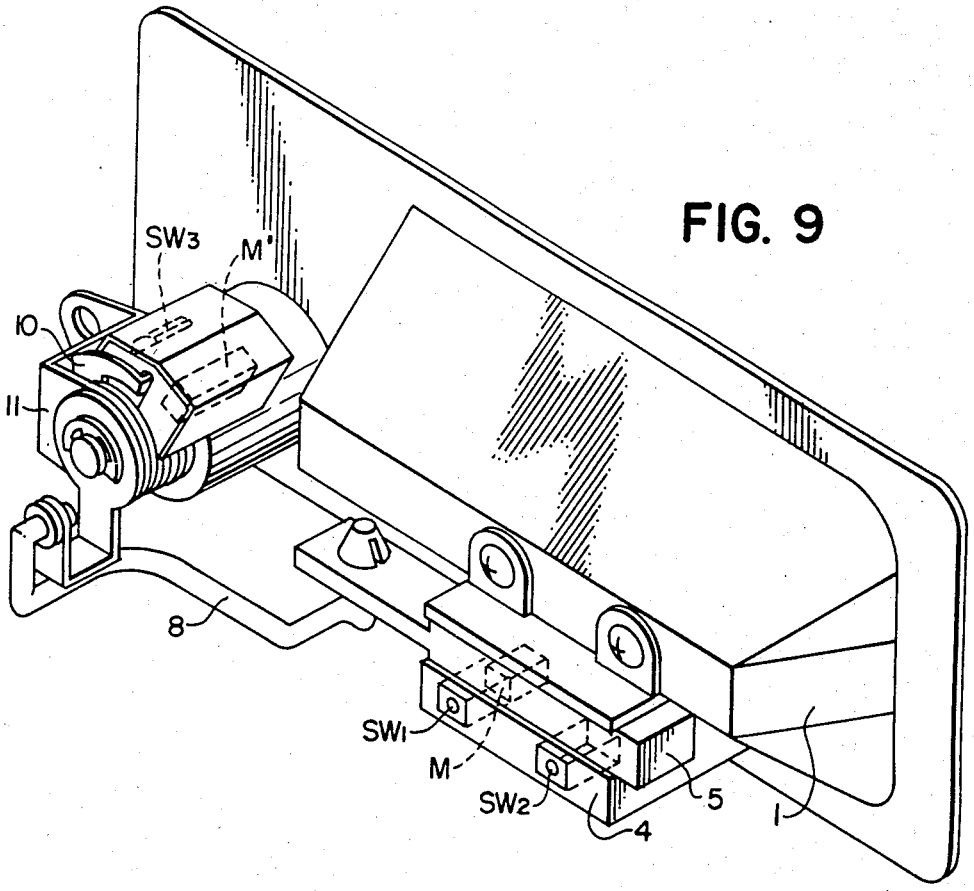
FIG. 9
FIG. 10a
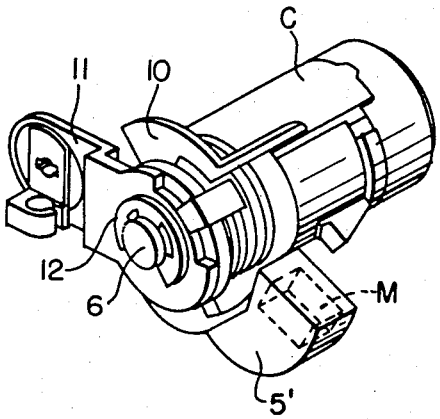
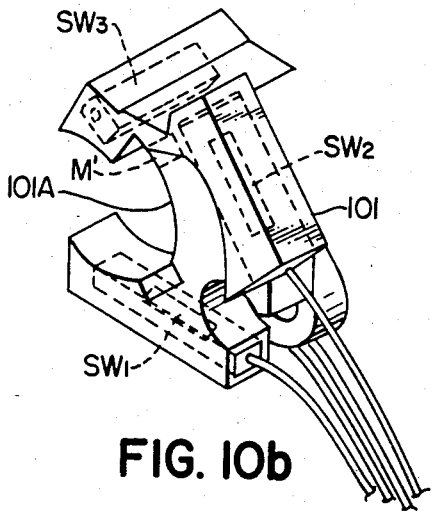
FIG. 10b

DETECTING DEVICE FOR DETECTING THE REMOVAL OF A CYLINDER LOCK

BACKGROUND OF THE INVENTION

The present invention relates to a device for detecting the removal of a cylinder lock when an unjust force is applied to the cylinder lock. Conventional cylinder locks used on cars are fixed with a retaining clip, etc. Therefore, such cylinder locks could be taken off by applying an unjust force to it with special tools, etc.

SUMMARY OF THE INVENTION

An object of the present invention is to provide a device for detecting the removal of a cylinder lock wherein detection can be immediately made when the cylinder lock has been taken off by an unjustly applied force.

Another object of the present invention is to provide a device for detecting the removal of a cylinder lock, the water proof characteristics and durability of which are improved.

In order to achieve these objects, in the present invention, the cylinder lock is provided with a base plate on which a magnetic sensor switch and a magnet are disposed adjacent to each other, and with a magnetic shield plate having one end thereof connected to the cylinder lock and the other end thereof being adapted to be inserted into the clearance between the magnetic sensor switch and the magnet. Detection of the removal of the cylinder lock is made at the time when the cylinder lock and base plate are taken off, or when the cylinder lock and magnetic shield plate are taken off.

BRIEF DESCRIPTION OF THE DRAWING

FIG. 9 is a perspective view of the first embodiment of the invention; and

FIGS. 10*a* and 10*b* are perspective views of the second embodiment of the invention.

DETAILED DESCRIPTION OF THE PREFERRED EMBODIMENTS

Figure 1:
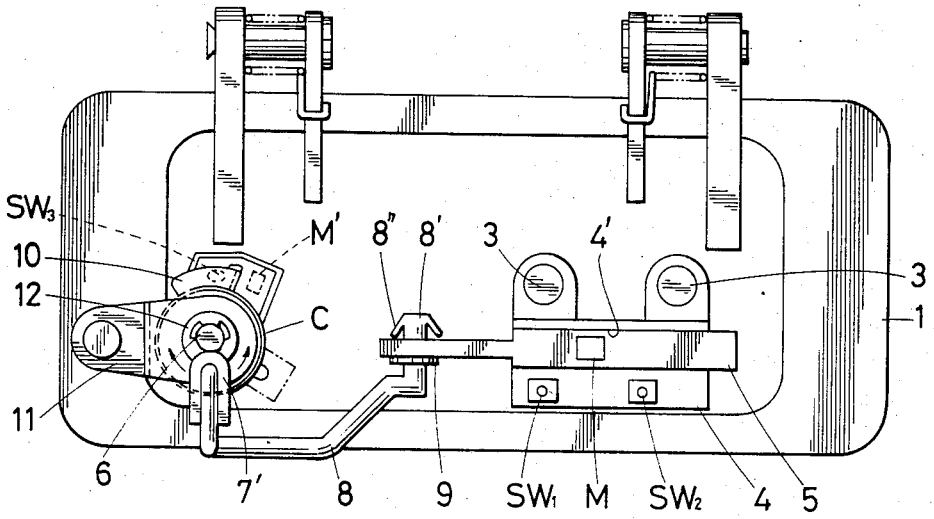
FIG. 1 is a rear elevational view of a first embodiment according to the present invention.
Figure 2:
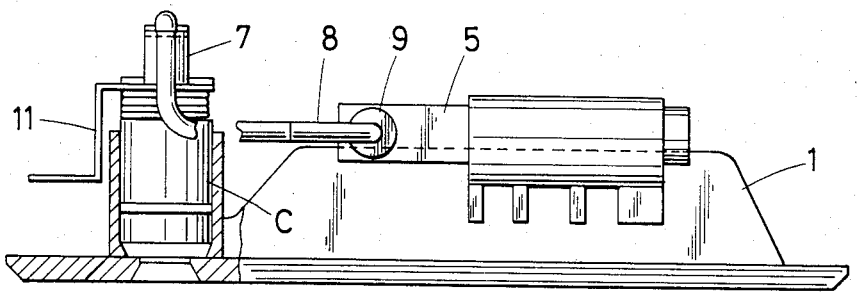
FIG. 2 is a partially cut away bottom view of FIG. 1.
Figure 3:
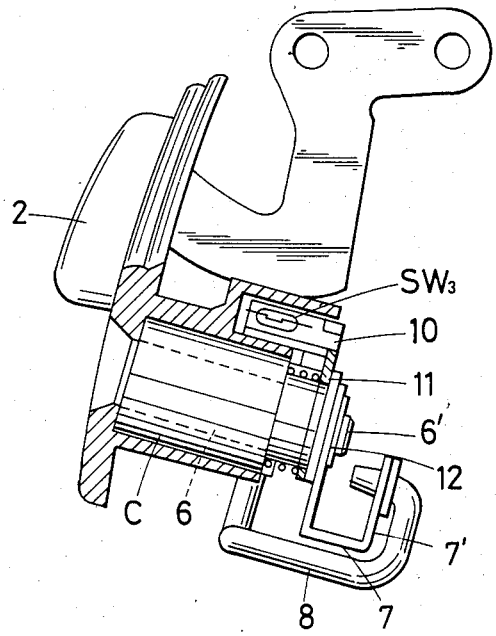
FIG. 3 is a partially cross-sectional side view showing the essential portions of a cylinder lock.
Figure 4:
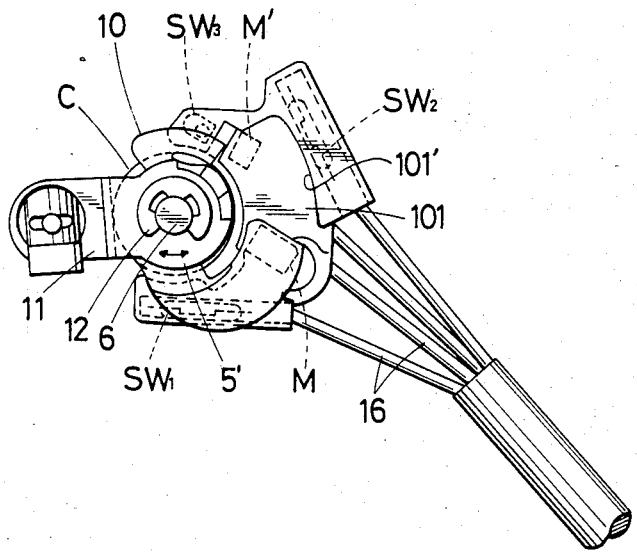
FIG. 4 is a rear elevational view of a second embodiment according to the present invention.
Figure 5:
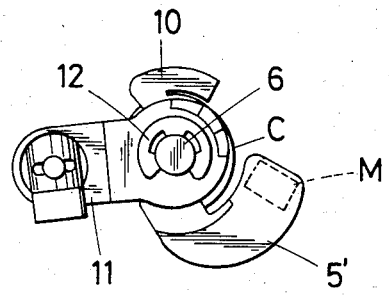
FIG. 5 is a rear elevational view of a magnet holder and a lever.
Figure 6:
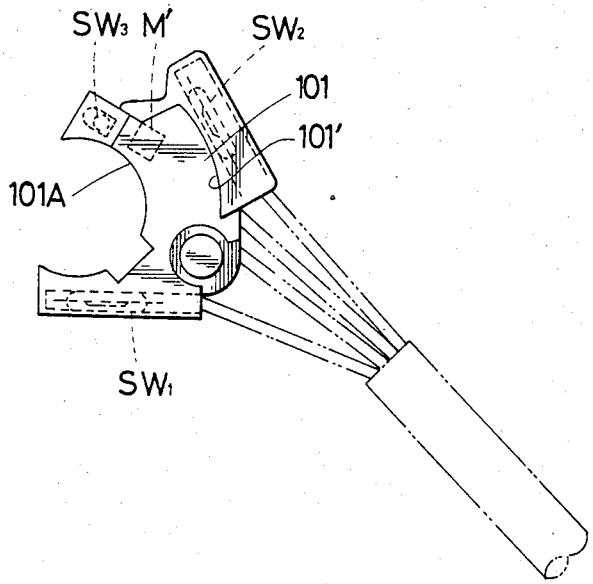
FIG. 6 is a rear elevational view of a base plate.
Figure 7:
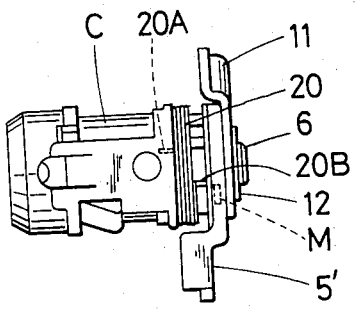
FIG. 7 is a side elevational view of the first embodiment of FIG. 1.
Figure 8:
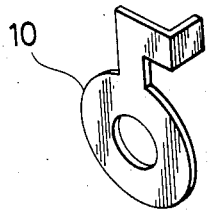
FIG. 8 is a perspective view of a shield plate.

Referring to FIG. 1 through FIG. 3 and FIG. 9, a housing 1 for an outside handle 2 is installed on a car door (not shown). On the back of the housing 1 which forms the base plate, a lead switch SW3, which is a magnetic sensor switch, and a magnet M′ are arranged opposite to each other with a clearance therebetween.

The action between the lead switch SW3 and the magnet M′ is such that, when one end of the magnetic shield plate 10 the other end of which is loosely fitted onto the rotor 6 of the cylinder lock is positioned within the clearance, the lead switch SW3 is not turned ON. However, when the magnetic shield plate 10 is removed away from the clearance, the lead switch SW3 is turned ON by the magnet M′.

When the cylinder lock C is taken off with a special tool, an E ring 12 which prevents the disassembling of the shield plate 10 connected to the rotor 6 of the cylinder lock C, a rotatable plate 7 and an actuating plate 11 for locking and unlocking is forcibly removed from the end 6′ of the rotor 6. Thus, the magnetic shield plate 10, the rotable plate 7 and the actuating plate 11 are also removed so that the magnetic shield plate 10 is removed from the clearance between the lead switch SW3 and the magnet M′, thus allowing the lead switch SW3 to turn ON through the magnet M′. Accordingly, the removal of the cylinder lock C is detected.

Further, the present embodiment includes a device for detecting the locked and unlocked conditions of the cylinder lock.

Lead switches SW1, SW2 are juxtaposed on the back of the housing. When either one of the lead switches SW1, SW2 is turned ON through the magnet M, the locked condition of the cylinder lock is detected and when the other is turned ON, the unlocked condition of the same is detected. Each of the lead swiches SW1, SW2 is fitted on a fixed member 4 which is affixed by pins 3 to the housing 1 along the longitudinal direction thereof.

In addition, a guide groove 4′ is formed on the fixed member 4. A slidable member 5 having a magnet embedded therein for turning each lead switch SW1 and SW2 ON is fitted into the guide groove 4′.

One end of the slidable member 5 is connected to one end 8′ of a bent rod 8 which has the other end thereof affixed on the bent portion 7′ of the rotatable plate 7 affixed to the rotor end 6′ of the cylinder lock C which is provided at one side of the housing 1. The bent rod 8 is of a plastic material in one embodiment of the present invention. Thus, at the connection between the slidable member 5 and the bent rod 8, a clip 9 having a resilient hook 8″ is provided at a tip portion of the bent rod 8 for holding the slidable member 5.

When the cylinder lock C is turned by a key (not shown) in the locking or unlocking direction, the rotor 6 of the cylinder lock is also rotated together, thus the rotatable plate 7, which is fitted to the rotor 6, is rotated in either of the directions shown by arrows, causing the slidable member 5 to slide, whereby the magnet M embedded in the slidable member 5 approaches either one of the lead switches SW1, SW2.

For instance, in FIG. 1, when the rotatable plate 7 is rotated clockwise, the magnet M approachs the lead switch SW1, thus turning the lead switch SW1 ON and detects the locked condition of the cylinder lock, and also, when the rotatable plate 7 is rotated counterclockwise, the magnet M moves to turn the lead switch SW2 ON, whereby the unlocked condition of the cylinder lock is detected.

A second embodiment will now be described referring to FIG. 4 through FIG. 8 and FIGS. 10*a* and 10*b*. In the second embodiment, a cylinder lock is directly affixed on a panel. This embodiment can also have a device for detecting the locked and unlocked conditions of the cylinder lock of which the description will be made hereinafter.

Indicated by C is, for instance, a cylinder lock installed near an outside handle disposed at the outside of a car, or installed on the lid of a trunk (not shown). At the rear end of the rotor 6 of the cylinder lock C, the base end portion of a shield plate 10 shown in FIG. 5, a magnet holder 5' and a lever 11 are connected through a coil spring 20 and through an E ring 12. By connecting one end 20A of the coil spring 20 onto the rotor 6 and connecting the other end 20B of the same onto the cylinder lock C, the shield plate 10, the magnet holder 5' and the lever 11 are biased back to an intermediate position of the cylinder lock.

A base plate 101 has an opening at one side thereof and is formed with a guide recess 101' and a cut portion 101A. The cylinder lock C is fitted into the cut portion 101A. Also magnetic sensor switches or lead switches SW1, SW2 are respectively provided on the base plate 101 for detecting the locked and unlocked conditions of the cylinder lock. The device for detecting the unjust removal of the cylinder lock is installed by arranging the magnet M' and the magnetic sensor switch or lead switch SW3 opposed to each other.

The magnet holder 5' can be rotated against the spring force of the coil spring 20, whereby the magnet M affixed on the magnet holder 5' approaches the lead switches SW1, SW2 and causes them to be actuated.

The shield plate 10 is made of a magnetic shield material such as aluminum which would not pass the flow of magnetic flux. One end of the shield plate 10 is loosely fitted onto the rotor 6 of the cylinder lock C and the other end of the same is bent. When the other end of the shield plate 10 is inserted into the clearance between the opposing magnet M' and lead switch SW3, the magnetic action of the magnet M' on the lead switch SW3 is prevented.

When the cylinder lock is not used, the magnet M embedded in one end of the magnet holder 5' is positioned in an intermediate position between the lead switches SW1 and SW2 by the force of coil spring 20.

When a key (not shown) is inserted into the cylinder lock and further turned clockwise into the locking position against the spring force of the coil spring, the lever 11 is turned together with the rotor 6 and locked there. At this time, the magnet M turns the lead switch SW2 ON wherein the locked condition is detected by other means.

When a key is inserted into the cylinder lock C in the locked condition and turned counterclockwise into the unlocking position, the cylinder lock is unlocked. At this time, the magnet M on the magent holder 5' approaches the lead switch SW1. By the magnetic action of the magnet, the lead switch SW1 is turned ON, whereby the unlocked condition of the cylinder lock C is detected.

Further, in the case where the cylinder lock is unjustly took off, the shield plate 10 which is fitted on the rotor of the cylinder lock is also removed. Therefore the magnet M' acts on the lead switch SW3 and turns it ON. Thus, it is possible to detect through the lead switch SW3 that the cylinder lock has been unjustly took off.

Lead switches are used for the magnetic sensor switch in the above two embodiments. However, Hall devices, magnetic heads, etc. can also be used.

Thus, according to the present invention, it is possible to immediately detect that the cylinder lock has been taken off by an unjustly applied force. Therefore, it can be used as a device for preventing robbery. Additionally, since magnetic sensor switches are used without any mechanical contact, the water proof characteristics and durablity are improved.

What is claimed is:

1. A detecting device for detecting the removal of a cylinder lock comprising a magnetic sensor switch and a magnet provided adjacent to each other on a base member and a magnetic shield plate having one end thereof connected to said cylinder lock and the other end thereof being adapted to be inserted into the clearance between said magnetic sensor switch and said magnet, wherein the removal of said cylinder lock causes said one end of said magnetic shield plate to be disconnected from said cylinder lock and said other end of said magnetic shield plate to be removed from said clearance between said magnetic sensor switch and said magnet, said magnetic sensor switch thereby turned on so that said removal of said cylinder lock is detected.

2. The detecting device for detecting the removal of a cylinder lock as claimed in claim 1, said magnetic sensor switch is a lead switch, and said one end of said magnetic shield plate is connected to the rotor of said cylinder lock, wherein said other end of said magnetic shield plate, when positioned in said clearance, keeps said lead switch OFF and, when removed from said clearance, turns said lead switch ON.

3. The detecting device for detecting the removal of a cylinder lock as claimed in claim 1, further comprising a pair of magnetic sensor switches and a second magnet which is adapted to move between said pair of magnetic sensor swiches in correspondence with the locked and unlocked conditions of said cylinder lock, wherein one of said pair of magnetic sensor switches is operated to detect the locked condition of said cylinder lock while the other of said pair of magnetic sensor switches is operated to detect the unlocked condition of said cylinder lock.

4. The detecting device for detecting the removal of a cylinder lock as claimed in claim 2, further comprising a pair of lead switches and a second magnet which is adapted to move between said pair of lead switches in correspondence with the clockwise and counter-clockwise rotations of said rotor, wherein one of said pair of lead switches is operated to detect the locked condition of said cylinder lock while the other of said pair of lead switches is operated to detect the unlocked condition of said cylinder lock.

5. The detecting device for detecting the removal of a cylinder lock as claimed in claim 4, said second magnet is adapted to slide linearly between said pair of lead switches.

6. The detecting device for detecting the removal of a cylinder lock as claimed in claim 4, said second magnet is adapted to rotate between said pair of lead switches.

7. The detecting device for detecting the removal of a cylinder lock as claimed in claim 1, wherein said magnetic shield plate is made of aluminum.

* * * * *

UNITED STATES PATENT AND TRADEMARK OFFICE

CERTIFICATE OF CORRECTION

PATENT NO. : 4,565,994

DATED : Jan. 21, 1986

INVENTOR(S) : MOCHIDA et al.

It is certified that error appears in the above-identified patent and that said Letters Patent is hereby corrected as shown below:

IN THE BIBLIOGRAPHICAL DATA:

At item [30] FOREIGN APPLICATION PRIORITY DATA, kindly correct the Priority Application Serial Number to read

-- 57-199712 --.

Signed and Sealed this

First Day of July 1986

[SEAL]

Attest:

DONALD J. QUIGG

Attesting Officer

Commissioner of Patents and Trademarks